United States Patent [19]

Taylor

[11] Patent Number: 4,789,356

[45] Date of Patent: Dec. 6, 1988

[54] COAXIAL CABLE CONNECTOR

[76] Inventor: Terry R. Taylor, 7303 Goodman Rd., Walls, Miss. 38680

[21] Appl. No.: 161,738

[22] Filed: Feb. 29, 1988

[51] Int. Cl.[4] ..... H01R 17/04

[52] U.S. Cl. ..... 439/584

[58] Field of Search ..... 439/578, 583, 584

[56] References Cited

U.S. PATENT DOCUMENTS 3,757,279 9/1973 Winston ..... 439/584

3,963,320 6/1976 Spinner ..... 439/584

*Primary Examiner*—Joseph H. McGlynn

*Attorney, Agent, or Firm*—Walker & McKenzie

[57] ABSTRACT

A coaxial cable connector for electrically connecting one end of a coaxial cable to a mating coaxial cable port. The connector includes a first connector structure for being electrically coupled to the coaxial cable port, and a second connector structure for being screwed into the second connector structure and for securing the coaxial cable to the first connector structure. The body of the second connector structure is sized with respect to the body of the first connector structure so as to cause the body of the second connector structure to be compressed and to clamp the coaxial cable thereto when the body of the second connector structure is screwed into the body of the first connector structure.

6 Claims, 2 Drawing Sheets

COAXIAL CABLE CONNECTOR

BACKGROUND OF THE INVENTION

1. Field of the Invention

The present invention relates, in general, to an apparatus for electrically coupling a coaxial cable to a coaxial cable connector.

2. Description of the Related Art

A preliminary patentability search in class 439, subclasses 583 and 584 disclosed the following U.S. Pat. Nos.: Schroder, 3,498,647; Hobart, 3,526,871; Forney, 4,441,781; and Dreyer, 4,557,546. None of the above patents discloses or suggests the present invention.

SUMMARY OF THE INVENTION

The present invention is directed toward providing an improved connector for electrically connecting one end of a coaxial cable to a mating coaxial cable port.

The connector of the present invention includes a first connector means for being electrically coupled to the coaxial cable port, the first connector means including a body having a first end for engaging the coaxial cable port and having a second end, at least a portion of the body of the first connector means having internal threads in the bore thereof adjacent the first end of the body thereof; and a second connector means for securing the coaxial cable to the first connector means, the body of the second connector means having a first end for being inserted into the second end of the bore of the body of the first connector means and having a second end, the body of the first connector means having a bore extending between the first and second ends thereof for receiving the coaxial cable, at least a portion of the body of the second connector means having external threads adjacent the second end thereof for screwably engaging the internal threads of the first connector means, the body of the second connector means having at least one slot extending from the first end thereof toward the second end thereof through at least a portion of the external threads thereof, the external threads of the body of the second connector means being sized with respect to the internal threads of the body of the first connector means so as to cause the body of the second connector means to be compressed adjacent the at least one slot and to clamp the coaxial cable thereto when the body of the second connector means is screwed into the body of the first connector means.

DESCRIPTION OF THE PREFERRED EMBODIMENT

Figure 1:
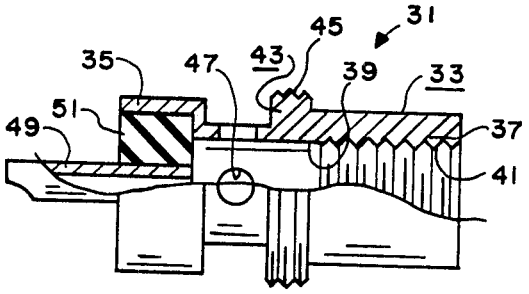
FIG. 1 is a front elevational view of a first connector means of the connector of the present invention with a portion thereof broken away to show certain internal structure.
Figure 2:
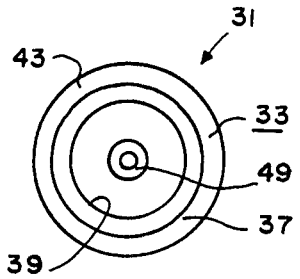
FIG. 2 is a right end elevational view of FIG. 1.
Figure 3:
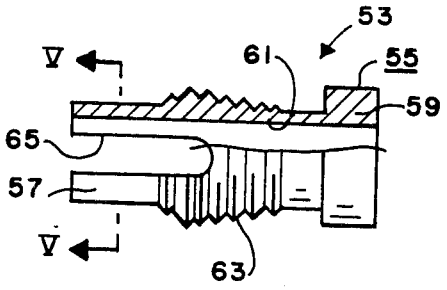
FIG. 3 is a front elevational view of a second connector means of the connector of the present invention with a portion thereof broken away to show certain internal structure.
Figure 4:
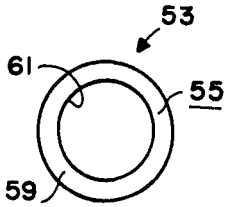
FIG. 4 is a right end elevational view of FIG. 3.
Figure 5:
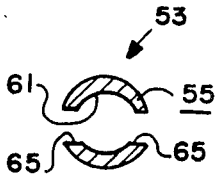
FIG. 5 is a sectional view as taken on line V—V of FIG. 3.
Figure 6:
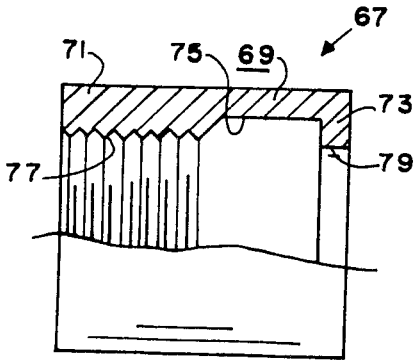
FIG. 6 is a front elevational view of a third connector means of the connector of the present invention with a portion thereof broken away to show certain internal structure.
Figure 7:
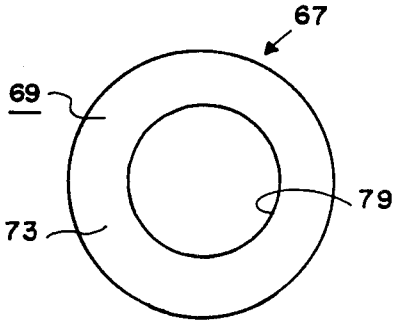
FIG. 7 is a right end elevational view of FIG. 6.
Figure 8:
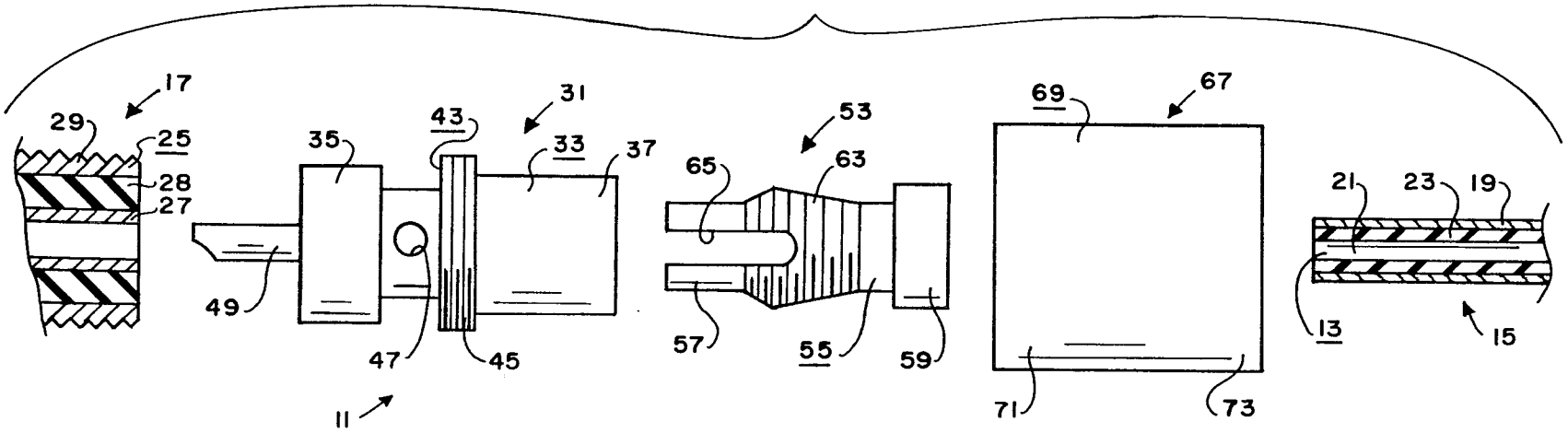
FIG. 8 is an exploded view of the connector of the present invention shown in conjunction with a coaxial cable and a mating coaxial cable port with portions thereof broken away to show certain internal structure.

The preferred embodiment of the connector 11 of the present invention is used to connect one end 13 of a coaxial cable 15 to a mating coaxial cable port 17. The coaxial cable 15 is typically the well-known type having an electrically conductive outer sheath 19 and an electrically conductive inner core 21 coaxially disposed with respect to one another and separated from one another by an insulator 23. The outer sheath 19 is preferably constructed of braided electrical conductive wires as will be apparent to those skilled in the art.

The mating coaxial cable port 17 may consist of any typical port such as the input or output coaxial cable port of an electrical device, one end of a coaxial cable (to thereby merely join one coaxial cable to another coaxial cable). etc., as will now be apparent to those skilled in the art. The mating coaxial cable port 17 typically includes an outer conductor 25 for being electrically coupled to the outer sheath 19, an inner conductor 27 coaxially disposed relative to the outer conductor 25 for being electrically coupled to the inner core 21, and an insulator 28 separating the outer and inner conductors 25, 27. The outer conductor 25 typically has external threads 29 thereon for reasons which will hereinafter become apparent.

The connector 11 of the present invention includes a first connector means 31 for being electrically coupled to the coaxial cable port 17. The first connector means 31 includes a body 33 having a first end 35 for engaging the coaxial cable port 17 and having a second end 37. The body 33 has a bore 39 extending completely therethrough between the first and second ends 35, 37 thereof. At least a portion of the body 33 of the first connector means 31 has internal threads 41 in the bore 39 thereof. The body 33 preferably has an outwardly directed flange portion 43 located between the first and second ends 35, 37 thereof for reasons which will hereinafter become apparent. The circumference of the flange portion 43 preferably has external threads 45 thereon for reasons which will hereinafter become apparent. The body 33 is adapted to be electrically coupled to the outer sheath 19 of the coaxial cable. Thus, for example, transverse apertures 47 may be provided through the body 33 for allowing the outer sheath 19 of the coaxial cable 15 to be soldered to the body 33 to electrically connect the outer sheath 19 of the coaxial cable 15 to the body 33. However, with the use of the present invention, a quick and efficient connection is made between the outer sheath 19 of the coaxial cable 15 and the body 33 of the first connector means 31 without the use of solder in apertures 47, as will be apparent from the description to follow later in this specification. The first end 35 of the body 33 is adapted to make electrical contact with the outer conductor 25 of the coaxial cable port 17 and thereby electrically connect the outer sheath 19 of the coaxial cable 15 with the outer conductor 25 of the coaxial cable port 17. The first connector means 31 preferably includes an electrically conductive tube 49 coaxially disposed relative within the bore 39 of the body 33 and fixedly joined to the first end 35 of the body 33 through an insulator 51. The tube 49 is adapted to make electrical contact with the inner core 21 of the coaxial cable 15 and with the inner conductor 27 of the coaxial cable port 17 to thereby electrically connect the inner core 21 of the coaxial cable 15 with the inner conductor 27 of the coaxial cable port 17.

The connector 11 includes a second connector means 53 for securing the coaxial cable 15 to the first connector means 31. The second connector means 53 includes a body 55 having a first end 57 for being inserted into the bore 39 of the body 33 of the first connector means 31 and having a second end 59. The body 55 of the second connector means 53 has a bore 61 extending between the first and second ends 57, 59 thereof for receiving the coaxial cable 15. At least a portion of the body 55 of the second connector means 53 has external threads 63 adjacent the second end 59 thereof for screwably engaging the internal threads 41 of the first connector means 31. The body 55 of the second connector means 53 has at least one and preferably a plurality of slots 65 extending from the first end 57 thereof toward the second end 59 thereof through at least a portion of the external threads 63 thereof. The external threads 63 of the body 55 of the second connector means 53 are sized with respect to the internal threads 41 of the body 33 of the first connector means 31 so as to cause the body 55 of the second connector means 53 to be compressed adjacent the slots 65 and to clamp the coaxial cable 15 thereto when the body 55 of the second connector means 53 is screwed into the body 33 of the first connector means 31.

The connector 11 preferably includes a third connector means 67 for securing the first connector means 33 to the coaxial cable port 17. The third connector means 67 includes a body 69 having a first end 71 for being attached to the coaxial cable port 17 and having a second end 73. The body 69 of the third connector means 67 has a bore 75 extending between the first and second ends 71, 73 thereof. The bore 75 preferably has internal threads 77 at the first end 71 for screwably coacting with the external threads 29 on the outer conductor 25 of the coaxial cable port 17 to affix the third connector means 67 to the coaxial cable port 17 as will now be apparent to those skilled in the art. The body 69 of the third connector means 67 preferably has an inwardly directed flange 79 adjacent the second end 73 thereof for engaging the flange portion 43 of the body 33 of the first connector means 31 to clamp the first connector means 31 to the coaxial cable port 17 as will now be apparent to those skilled in the art.

Figure 10:
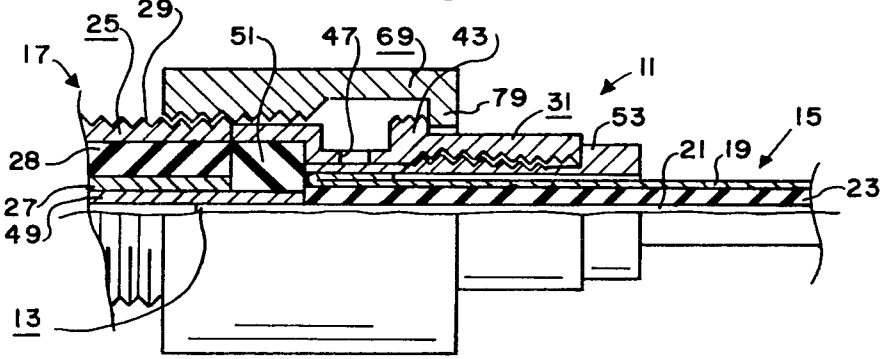
FIG. 10 is a sectional view of the connector of the present invention shown connecting the coaxial cable to the mating coaxial cable port.
Figure 9:
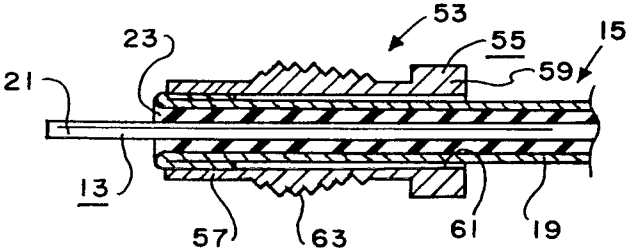
FIG. 9 is a sectional view of the second connector means of the connector of the present invention shown associated with the coaxial cable.

To use the connector 11, the end 13 of the coaxial cable 15 is inserted through the bore 61 of the body 55 of the second connector means 53 until it extends past the first end 57 of the body 55. A portion of the outer sheath 19 of the end 13 of the coaxial cable 15 is folded back over itself with the second connector means 53 is positioned over the folded back portion of the outer sheath 19 as shown in FIGS. 9 and 10. The bore 61 through the second connector means 53 is preferably sized so as to form a fairly tight fit with the folded back portion of the outer sheath 19. A portion of the insulator 23 is removed therefrom to expose the inner core 21. The first connector means 31 is then screwed onto the second connector means 53. As the external threads 63 are engaged by the internal threads 41, the first end 57 of the body 55 of the second connector means 53 will clamp down onto the coaxial cable 15 about the slots 65 to securely attach the coaxial cable 15 relative to the first connector means 31 and form an electrical connection between the inner core 21 of the coaxial cable 15 and the tube 49 and between the outer sheath 19 of the coaxial cable 15 and the body 33 of the first connector means 31 through the body 55 of the second connector means 53 as will now be apparent to those skilled in the art. If desired, solder or the like can be used to additionally secure the coaxial cable 15 to the first connector means 31. The tube 49 of the first connector means 31 is then inserted into the inner conductor 27 of the coaxial cable port 17 to form an electrical connection therebetween and the third connector means 67 screwed onto the outer conductor 25 of the coaxial cable port 17 until an electrical connection is made between the first end 35 of the body 33 of the first connector means 31 and the outer end of the outer conductor 25 of the coaxial cable port 17 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A coaxial cable connector for electrically connecting one end of a coaxial cable to a mating coaxial cable port, said connector comprising:

(a) a first connector means for being electrically coupled to said coaxial cable port, said first connector means including a body having first end for engaging said coaxial cable port and having a second end and having a bore extending completely therethrough between said first and second ends thereof, at least a portion of said body of said first connector means having internal threads in said bore thereof adjacent said first end of said body thereof; and (b) a second connector means for securing said coaxial cable to said first connector means, said second connector means including a body having a first end for being inserted into said bore of said body of said first connector means and having a second end, said body of said second connector means having a bore extending between said first and second ends thereof for receiving said coaxial cable, at least a portion of said body of said second connector means having external threads adjacent said second end thereof for screwably engaging said internal threads of said first connector means, said body of said second connector means having at least one slot extending from said first end thereof toward said second end thereof through at least a portion of said external threads thereof, said external threads of said body of said second connector means being sized with respect to said internal threads of said body of said first connector means so as to cause said body of said second connector means to be compressed adjacent said at least one slot and to clamp said coaxial cable thereto when said body of said second connector means is screwed into said body of said first connector means.

2. The connector of claim 1 in which said external threads of said body of said second connector means are tapered.

3. The connector of claim 1 in which is included a third connector means for securing said first connector means to said coaxial cable port.

4. The connector of claim 3 in which said coaxial cable port has a threaded portion, and in which said third connector means has a threaded portion for being screwed onto said threaded portion of said coaxial cable port.

5. The connector of claim 1 in which said external threads of said body of said second connector means have a first end located toward said first end of said body of said second connector and have a second end located toward said second end of said body of said second connector means, said external threads of said body of said second connector means tapering inwardly generally from said first end thereof to said second end thereof.

6. An improved coaxial cable connector for electrically connecting one end of a coaxial cable to a mating coaxial cable port, said connector comprising a first connector means for being electrically coupled to said coaxial cable port, said first connector means including a body having first end for engaging said coaxial cable port and having a second end and having a bore extending completely therethrough between said first and second ends thereof, at least a portion of said body of said first connector means having internal threads in said bore thereof adjacent said first end of said body thereof; a second connector means for securing said coaxial cable to said first connector means, said body of said second connector means having a first end for being inserted into said bore of said body of said first connector means and having a second end, said body of said first connector means having a bore extending between said first and second ends thereof for receiving said coaxial cable, at least a portion of said body of said second connector means having external threads adjacent said second end thereof for screwably engaging said internal threads of said first connector means; and a third connector means for securing said first connector member to said coaxial cable port; wherein the improvement comprises: said body of said second connector means having at least one slot extending from said first end thereof toward said second end thereof through at least a portion of said external threads thereof, said external threads of said body of said second connector means being sized with respect to said internal threads of said body of said first connector means so as to cause said body of said second connector means to be compressed adjacent said at least one slot and to clamp said coaxial cable thereto when said body of said second connector means is screwed into said body of said first connector means.

* * * * *